US008291719B2

(12) United States Patent
Cowans et al.

(10) Patent No.: US 8,291,719 B2
(45) Date of Patent: Oct. 23, 2012

(54) THERMAL CONTROL SYSTEM AND METHOD

(75) Inventors: William W. Cowans, Fullerton, CA (US); Glenn W. Zubillaga, Canyon Lake, CA (US); Kenneth W. Cowans, Fullerton, CA (US)

(73) Assignee: BE Aerospace, Inc., Wellington, FL (US)

( * ) Notice: Subject to any disclaimer, the term of this patent is extended or adjusted under 35 U.S.C. 154(b) by 618 days.

(21) Appl. No.: 12/285,596

(22) Filed: Oct. 9, 2008

(65) Prior Publication Data

US 2009/0105889 A1 Apr. 23, 2009

Related U.S. Application Data

(60) Provisional application No. 60/998,093, filed on Oct. 9, 2007, provisional application No. 61/011,862, filed on Jan. 22, 2008.

(51) Int. Cl.
*F25B 41/04* (2006.01)

(52) U.S. Cl. ..... 62/222; 62/513

(58) Field of Classification Search ..... 62/222, 62/126, 228.3, 513, 121, 129, 196.4
See application file for complete search history.

(56) References Cited

U.S. PATENT DOCUMENTS 3,852,974 A * 12/1974 Brown ..... 62/79
4,032,070 A * 6/1977 Nielsen ..... 236/92 B
4,438,881 A * 3/1984 Pendergrass ..... 237/2 B
5,095,712 A * 3/1992 Narreau ..... 62/113
5,245,833 A 9/1993 Mei et al.
5,426,952 A * 6/1995 Bessler ..... 62/211
5,622,055 A * 4/1997 Mei et al. ..... 62/113
5,845,502 A 12/1998 Chen et al.
5,899,091 A * 5/1999 Fraser et al. ..... 62/473
6,233,958 B1 5/2001 Mei et al.
RE37,630 E * 4/2002 Behr ..... 62/80
6,460,358 B1 * 10/2002 Hebert ..... 62/225
6,644,048 B2 11/2003 Goth et al.
7,059,151 B2 * 6/2006 Taras et al. ..... 62/513
7,178,353 B2 2/2007 Cowans et al.
7,228,700 B2 * 6/2007 Matsumoto et al. ..... 62/324.1
7,316,120 B2 * 1/2008 Aoki et al. ..... 62/324.4
7,370,493 B2 * 5/2008 Suzuki et al. ..... 62/513
7,377,126 B2 * 5/2008 Gorbounov et al. ..... 62/513
7,415,835 B2 8/2008 Cowans et al.
7,690,211 B2 * 4/2010 Sakurai et al. ..... 62/197
2004/0134225 A1 * 7/2004 Sakamoto et al. ..... 62/498
2005/0126193 A1 * 6/2005 Lifson et al. ..... 62/175
2005/0150248 A1 * 7/2005 Manole ..... 62/513
2006/0042274 A1 * 3/2006 Manole ..... 62/77
2006/0090502 A1 * 5/2006 Taras et al. ..... 62/510
2007/0095087 A1 * 5/2007 Wilson et al. ..... 62/259.2

* cited by examiner

*Primary Examiner* — Mohammad Ali
(74) *Attorney, Agent, or Firm* — Mattingly & Malur, P.C.

(57) ABSTRACT

A system for improving the thermal efficiency of a thermal control loop in which refrigerant after compression and condensation is applied to an evaporator employs a subsidiary counter-current heat exchange intercepting refrigerant flow to maintain the quality of the refrigerant by exchanging thermal energy between the input flow and the output flow from the evaporator. The same principle is effective, with particular advantage when small connections have to be made, in systems using mixed phase media and using the concept of direct energy transfer with saturated fluid.

12 Claims, 10 Drawing Sheets

Heat transfer in evaporators h simplification

EPC cycle

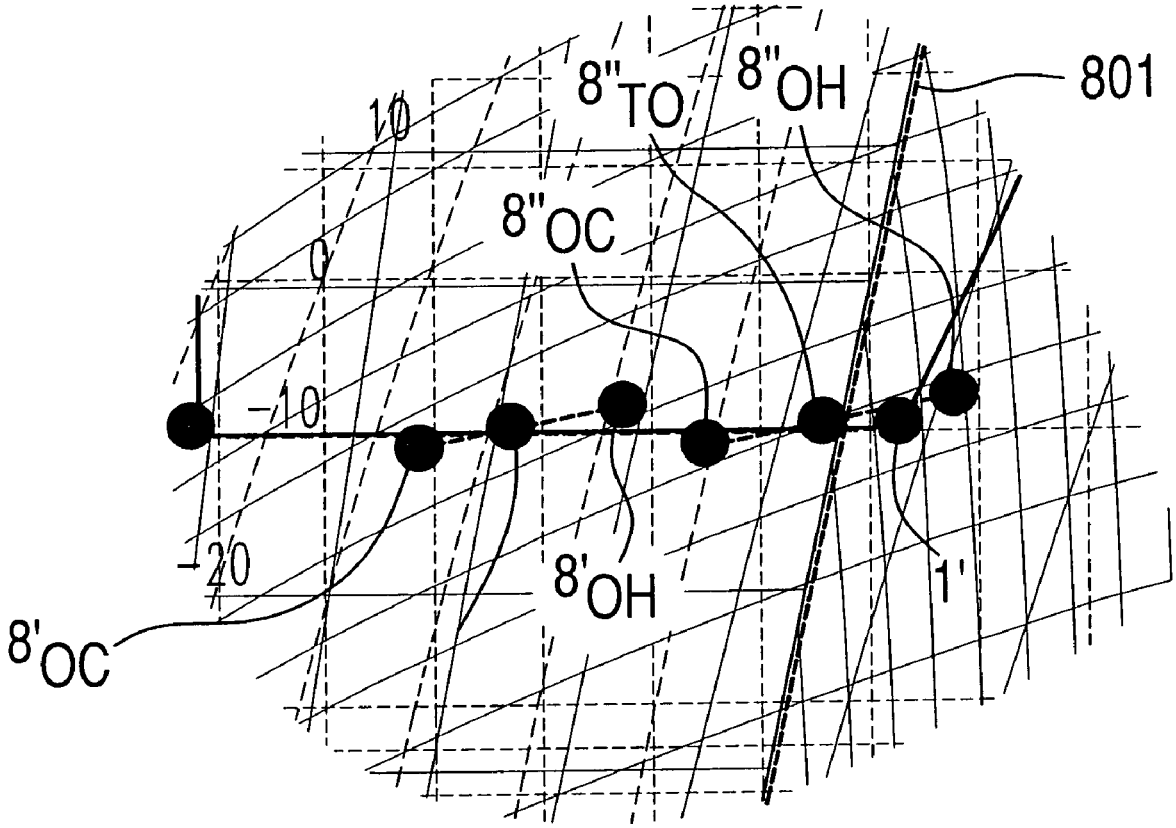
Fig. 8 Detail

Alternate
EPC cycle

THERMAL CONTROL SYSTEM AND METHOD

CROSS-REFERENCE TO RELATED APPLICATIONS

This invention relies for priority on a provisional application filed Oct. 9, 2007 by Kenneth W. Cowans entitled "Improved Vapor Cycle System and Method", Ser. No. 60/998,093 and on a second provisional patent application entitled "Enhanced Post Condensation for System Using Direct Transfer of Saturated Fluids" filed by the same inventor on Jan. 22, 2008, Ser. No. 61/011,862.

FIELD OF THE INVENTION

This invention relates to thermodynamic systems and methods which utilize vapor cycle processes, such as systems for air conditioning, refrigeration and other temperature control applications, and more particularly to providing improvements in efficiency in such systems and methods by using novel approaches to thermodynamic sequencing.

BACKGROUND OF THE INVENTION

Many systems for industrial and residential control of environmental temperatures employ continuous vapor cycle sequences, which have been widely employed and have subsequently evolved into many different configurations. Typically, such systems continuously cycle a two-phase fluid, such as a refrigerant with a suitable evaporation point, by first pressurizing the refrigerant into a hot gas phase and then condensing the refrigerant to a liquid phase of suitable enthalpy for subsequent controlled expansion to a lower target temperature. Thus cooled, the refrigerant is passed in heat transfer relation to a thermal load, usually by employing an inert heat transfer fluid, and the two-phase refrigerant is thereafter cycled back within a closed loop for repressurization and subsequent condensation.

A meaningful departure from this approach to industrial and residential temperature control is described in recently issued patents U.S. Pat. No. 7,178,353 and U.S. Pat. No. 7,415,835 to inventors Kenneth W. Cowans et al. This departure is directed to a novel temperature control system which combines flows of refrigerant in a hot gas pressurized mode with the same refrigerant in an expanded vapor/liquid mode. The system combines some expanded refrigerant flow with a suitable proportion of pressurized hot gas in a closed circuit vapor-cycle refrigeration system. The combined refrigerant stream generated can exchange thermal energy directly with a load, as in a heat exchanger (HEX). Such systems offer substantial benefits in improving heat transfer efficiency and economy and in enabling rapid and precise temperature level changes. Since they require no intermediate coolant and the pressure can be varied rapidly, this approach, which for succinctness has sometimes been termed TDSF for "Transfer Direct of Saturated Fluids" offers distinct operative and economic advantages for many temperature control applications.

Many different improvements involving special thermal exchanges between different fluids have been offered for use in the broad field of temperature control systems. A patent to Goth et al, U.S. Pat. No. 6,644,048 dated Mar. 10, 2003 for example, proposes a scheme for modifying a refrigerant used directly in heat exchange relation to a thermal process, by employing a controlled solenoid valve to inject bursts of hot pressurized gas into a cold refrigerant. This is done to assist in transitions from colder temperature level to higher temperature levels, such as for startup, cleaning, and other purposes. The Goth et al patent does not teach control at a selected or variable temperature level, and is concerned with increasing the temperature level by adding one or more bursts of hot gas for the purpose of avoiding water condensing on sensitive electronic circuits. It accordingly is not useful as a basis for generating precisely controlled temperature levels across a range of temperatures.

Other patents propose the use of special HEXs for establishing special effects. For example, U.S. Pat. No. 5,245,833 to V. C. Mei et al, entitled "Liquid Over-Feeding Air Conditioning System and Method" discloses a "liquid over-feeding" operation in which heat is exchanged in an accumulator-heat exchanger. This exchange is between a hot liquid refrigerant, and a cooler output refrigerant, after which the refrigerant is expanded for cooling before being applied to the evaporative load. This sequence subcools the refrigerant to allow more of the evaporator surface to be used for cooling. A later variant of this approach is disclosed in U.S. Pat. No. 5,622,055, entitled "Liquid Over-Feeding Refrigeration System and Method with Integrated Accumulator-Expander-Heat Exchanger" by V. C. Mei et al. This variant improves heat transfer by subcooling the refrigerant to a lower level using a capillary tubing immersed in a pool of liquid refrigerant. This approach requires a unified vapor cycle configuration, with specially modified evaporator and exchangers and is not readily suitable for modifying existing compressor-condenser systems so as to improve efficiency and save energy.

Different approaches to energy saving have also been disclosed by the same inventor teams in two heat pump patents, namely U.S. Pat. No. 5,845,502 to F. C. Chen et al entitled "Heat Pump for an Improved Defrost System" and U.S. Pat. No. 6,233,958 to V. C. Mei et al entitled "Heat Pump Water Heater and Method of Making the Same". The expedients used are primarily of interest to the heat pump approach and do not suggest how thermal efficiency improvements can feasibly be effected by modifying existing vapor cycle system for energy conservation.

As energy demands have continued to increase and limitations on the use of energy sources have continued to be encountered, it has become increasingly evident that much can be gained by improving the efficiency of present systems. Even relatively modest improvements in the energy usage of air conditioning systems, for example, can pay substantial dividends over the long periods of use that such systems undergo. Accordingly, any economically realizable modification of the thermodynamics of basic vapor cycle sequence that provides meaningful efficiency improvement, reductions in energy costs, or both, can have broad consequences for vapor cycle systems.

In accordance with the Cowans et al patents previously alluded to, substantial benefits are in fact gained because of the inherent advantages of direct transfer of thermal energy using a saturated fluid, (the TDSF approach). Such systems employ a vapor cycle configuration in which the pressure-enthalpy interactions in the cycle are inherently more complex because they use, in integrated fashion, both hot gas and expanded vapor mixed with liquid. Because of asymmetries between the thermal exchange characteristics of these two flowing media, instabilities and imprecision can arise in temperature control applications especially when corrections are small and loads are low. Achieving improvements in internal efficiency in TDSF-types systems can be of benefit, but imposes special problems.

SUMMARY OF THE INVENTION

Improvements in vapor cycle systems used for refrigeration or heat exchange are realized by modifying the conventional vapor cycle to incorporate an additional thermal exchange step after expansion of compressed condensed refrigerant. This interchange of thermal energy is then between the expanded refrigerant and the return flow from the evaporator and is accompanied by a controlled pressure drop, which introduces enhanced post condensing (EPC). The post condensation lowers the quality level (ratio of vapor mass to total mass) of refrigerant delivered to the evaporator and raises the effective heat transfer coefficient (h) during energy exchange with the load. This expedient increases the bulk density of the mass moving through the evaporator and lowers the pressure drop introduced, minimizing heat transfer losses in the low efficiency region of the evaporator. The controlled pressure drop, provided by a pressure dropping device, introduces a substantially constant pressure difference to assure that no expanded vapor and liquid flows during those times when maximum heating is desired.

The expanded liquid/vapor mix feeds pressurized input to one side of a two-phase HEX prior to the evaporator; the HEX also receives a flow of output derived from the evaporator after having serviced the load. A pressure dropping valve introduces a temperature drop of the same order of magnitude in the two-phase mixture as the mass superheat used to regulate the cooling temperature with the thermal expansion valve. This temperature drop thusly created drives heat to pass from one flow in the HEX to the other flow. Consequently by introduction of a relatively small HEX and a pressure dropping device in a given temperature control unit an overall gain in h is achieved. This results in a net gain in efficiency.

Application of this principle to TDSF systems employs the flow of fluids through a supplemental HEX which is generally relatively smaller than the load, and also employs a pressure dropping valve to make a temperature difference available to drive heat across said supplemental HEX so as to introduce further condensation. This combination uniquely effects TDSF system operation by acting to limit and smooth out deviations in temperature changes as well as increasing system efficiency. Small changes in temperature level can be introduced by precise valve regulation of the flow of hot gas into the mixture.

If a slightly higher temperature is needed and/or operation is to be at a low flow or power level, the situation is different, because the pressurized hot gas source presents a much larger potential energy input (than does condensed liquid vapor input after expansion) so that stability and precision can be problematic if temperature is to be raised a relatively small amount. In this situation, employment of enhanced post condensation is effective in changing the flow rate of pure gaseous medium at high pressure so that the control of temperature becomes much more precise particularly at higher temperatures where it may be necessary to heat and cool alternately in order to control temperature. The HEX and pressure dropping valve in the flow path compensate for nonlinearity in thermal energy exchange by smoothing the rate of change of temperature increase and ensuring thermodynamic balance. Employing EPC in the TDSF context, therefore, assures that a higher, stable temperature level can be attained more rapidly regardless of the increment of change and the power level involved.

BRIEF DESCRIPTION OF THE DRAWINGS

A better understanding of the invention may be had by reference to the following description, taken in conjunction with the accompanying drawings, in which:

FIG. 2 also shows the practical effect of using the EPC in a vapor-cycle cooling system. By raising the value of (the heat transfer coefficient) with the use of the EPC the evaporating temperature can be raised while effecting the same cooling effect in the air flowing by the HEX. The "Enhanced temperature" shown in FIG. 2 is that temperature (25° F.) which produces the same effect as does 15° F. without the use of EPC. The efficiency of such a system is raised by more than 20% by this change.

DESCRIPTION OF THE PREFERRED EMBODIMENT

Figure 1:
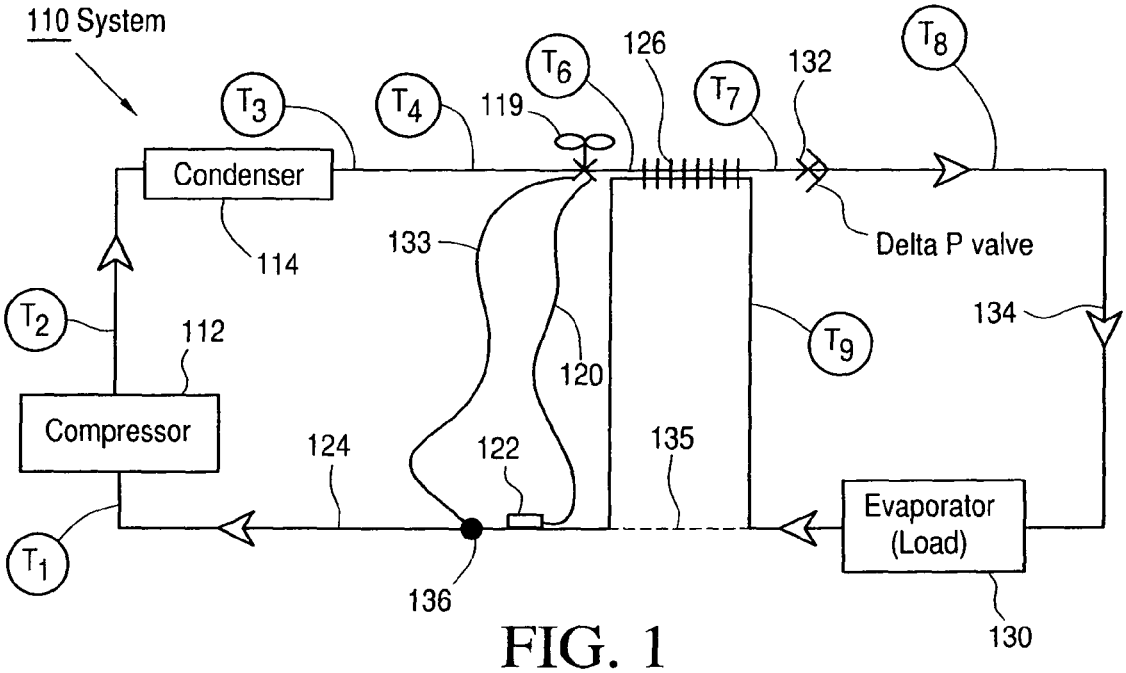
FIG. 1 is a block diagram representation of an improved vapor cycle temperature control system incorporating enhanced post condensation (EPC) in accordance with the invention.

An exemplary thermal control system which includes the EPC, shown by the way of example only, which may advantageously be a commercial air cooling system, is depicted in the block diagram view of FIG. 1, to which reference is now made. In this Figure, for convenience in referring to different points in the thermodynamic cycle, circled numbers ($T_1$) to ($T_9$), are incorporated in the Figure and referred in this specification. These points, numbered (1) to (9) are also depicted in the Mollier diagram of FIG. 5. The system 110 comprises a vapor cycle refrigeration system having a conventional compressor 112 which feeds a high pressure, high temperature output as a pressurized gas to a condenser 114. The condenser 114 reduces the refrigerant temperature to a primarily liquid state at ambient or near ambient temperature. The condenser 114 may be liquid or air cooled, and may use a regulated coolant control or be unregulated. The liquefied pressurized product from the condenser 114 in input to an externally equalized thermal expansion valve (hereafter TXV) 119. TXV 119 has a conventional internal diaphragm (not shown)

whose position determines the amount of flow through TXV 119. The TXV 119 diaphragm position is responsive to the difference in pressures between the input line 124, communicated to TXV 119 through the line 133, to compressor 112 and that of the pressure of a liquid contained in a closed volume bulb 122 communicated through a tubing line 120. Bulb 122 is placed in close thermal communication with input line 124 at or near the point 136 at which pressure in input line 124 is measured to communicate with said diaphragm in TXV 119. The TXV 119 uses the difference between these pressures to open and close the TXV 119 to provide the maximum amount of cooling at the lowest achievable temperature.

The expanded output of TXV 119 is delivered at point $T_6$ as one input to a subsidiary HEX 126 in the refrigerant path leading to the evaporator, which is the load 130. In the subsidiary HEX 126 the expanded fluid from the TXV flows in heat exchange relation with returned refrigerant at point ($T_9$) from the system load (evaporator) 130 that ultimately feeds the suction input line 124 to the compressor 112. This return line from the load 130 through the HEX 126 to the compressor 112 input therefore forms part of a subsidiary heat exchange loop configured and operated to provide improved heat transfer. In this subsidiary loop to the evaporator 130, the outflow from the TXV 119 at point ($T_6$) first passes through HEX 126, and then a stabilizing flow impedance 132. The latter thus introduces a temperature drop somewhat greater than the maximum superheat used to regulate the cooling temperature with the TXV 119 or other expansion device that is used. Here the stabilizing impedance advantageously comprises a differential or delta pressure (ΔP) valve 132, which provides a controlled pressure drop. The ΔP valve 132 here induces a temperature drop that approximates the difference between the evaporating refrigerant and the load being cooled, since the evaporator 130 superheat is a factor critical to stable operation.

In operation, the system of FIG. 1 provides the basic compression and condensation functions of a vapor cycle system, feeding the liquefied, pressurized refrigerant to the TXV 119, which then controls the expansion, consequently the major amount of cooling, of the refrigerant, at point ($T_6$) of FIG. 1. A capillary having a fixed aperture and pressure drop may alternatively be used, but the TXV 119 is more functional in systems which are designed for high efficiency.

FIG. 1 also depicts how a standard vapor cycle without EPC can alternatively be configured. If the flow out of load 130 were to pass through alternate line 135, shown in dashed form, said flow would bypass EPC HEX 126 and flow directly to compressor 112. In this case the valve 132 would not serve any particular purpose. It would simply be a part of the impedance of TXV 119. The system would then function exactly as a standard vapor-cycle cooling system.

Figure 5:
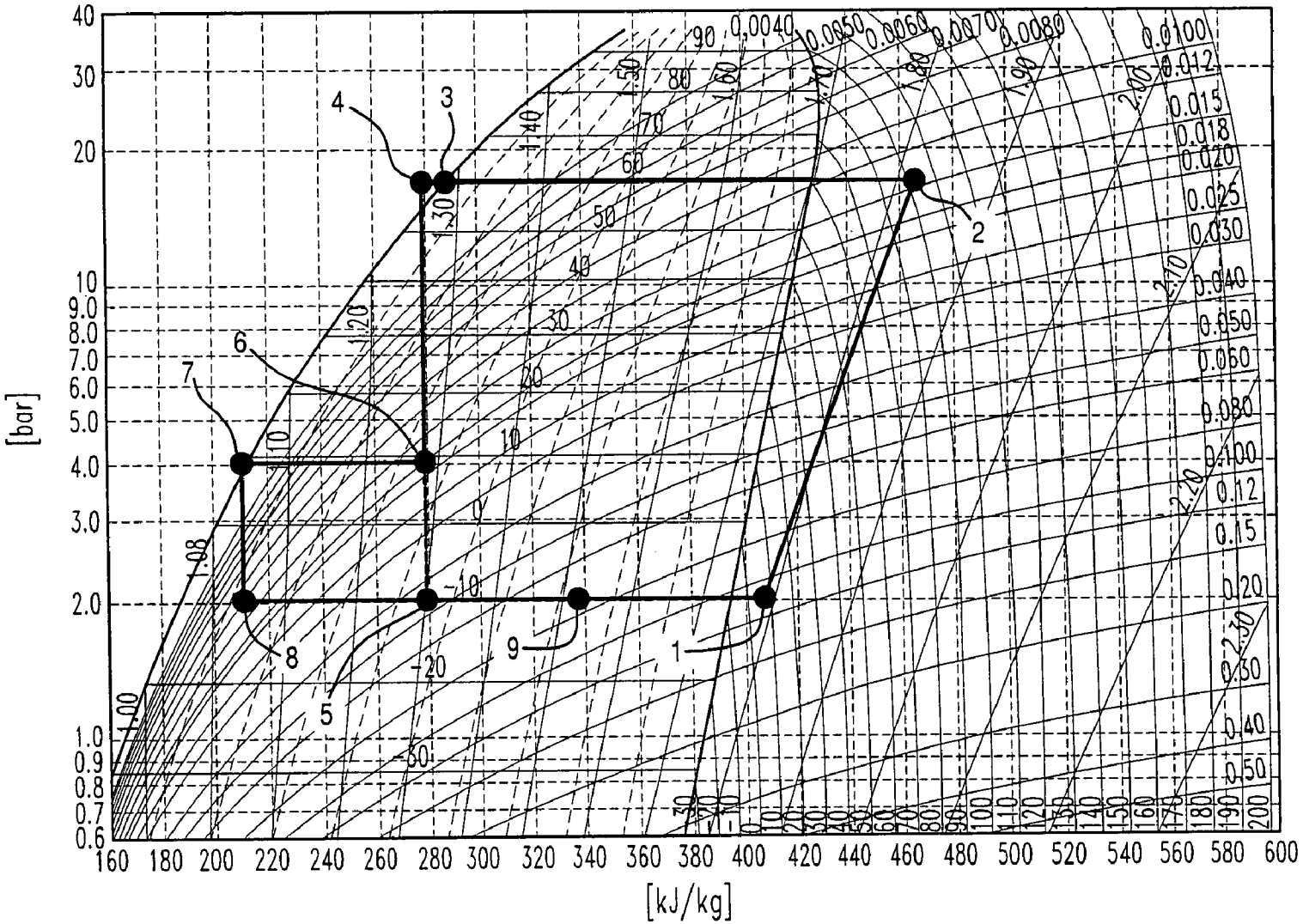
FIG. 5 is a Mollier diagram of enthalpy vs. pressure showing variations in a vapor cycle sequence using enhanced post condensation in accordance with the invention.

In the EPC HEX 126 the thermodynamic cycle undergoes a fundamental variation from the usual cycle, exchanging thermal energy between the return flow from and the input flow to the evaporator 130. Refer to FIG. 5, which comprises a Mollier diagram showing exchange between flow in the return line from the evaporator or load 130 points ($T_9$) to ($T_1$) and input flow from the TXV 119, at points ($T_6$) to ($T_7$), to the evaporator 130. The input flow temperature is then dropped as refrigerant passes through the adjacent ΔP valve 132. Within this subsidiary heat exchange loop, as seen in the pressure vs. enthalpy Mollier diagram of FIG. 5, the thermal energy exchange between points ($T_6$) and ($T_7$) on the outgoing flow and points ($T_9$) to ($T_1$) in the return flow is effectively substantially equal. However, this makes possible enhanced post condensation. The refrigerant in boiling its liquid from $T_9$ to $T_1$ provides enough cooling to condense liquid on the other side of HEX 126 to reduce the enthalpy of the input refrigerant from $T_6$ to $T_7$. This heat transfer is driven by the temperature difference from $T_{7,6}$ to $T_{9,1}$ This temperature difference is created by the effect of pressure dropping valve 132. The pressure drop in the ΔP valve 132 lowers the temperature. The combined effect of the HEX 126 and the ΔP valve 132 reduces the quality (vapor mass percentage to total mass percentage) of the refrigerant that is delivered to the load 130.

Figure 2:
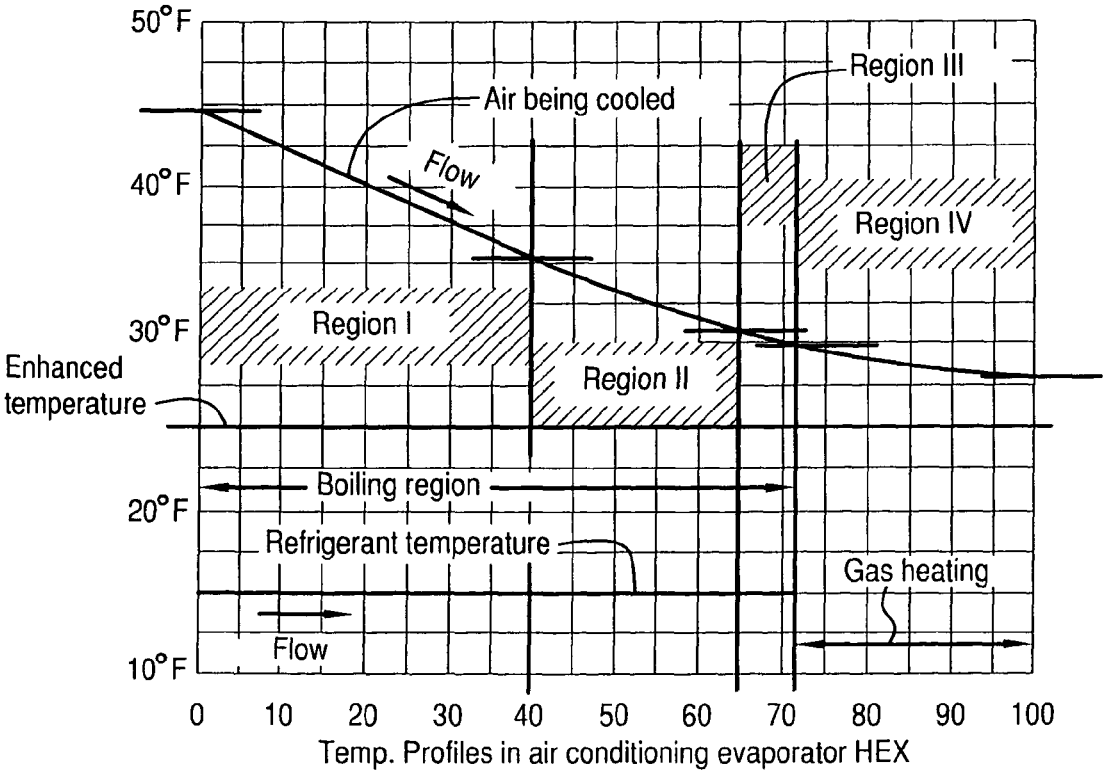
FIG. 2 is a graph of temperature variations in fluids flowing along the length of an evaporator in a conventional vapor cycle system used as an air chiller.

This is significant to the efficiency improvements achieved in the disclosed system because it compensates for the different heat transfer characteristics that exist along the length of the typical evaporator 130 as the vapor mass changes, as shown in FIG. 2. Referring to FIG. 2 a practical consideration in the design of an economically justifiable evaporator is that the conventional evaporator utilizes a relatively economical construction based on constant cross-sectional area for the majority of its length. Heat transfer in such a passage, for different spans of regions along the evaporator length, is as depicted in FIG. 2. The h is dependent on the maximum mass velocity per unit cross-section area, and also on the "quality" of the mixture of vapor and liquid. As the refrigerant passes into Region I of the evaporator, as depicted in FIG. 2, liquid in the mixture is boiled off, providing a known rate of heat transfer. The boil off increases the linear velocity of the mixture, which in turn drives up the heat transfer coefficient to a maximum until the quality exceeds about 70%. This is shown clearly in FIG. 4. When, however, the amount of liquid in the mix diminishes to the point at which the liquid does not adequately wet the walls of the HEX, at the beginning of Region II of FIG. 2, the h falls off. It does so precipitously as the refrigerant approaches a pure gas. This is shown in each of FIGS. 3 and 4. Finally, as seen at Region IV of FIG. 2, thermal exchange is only with pure gas, which is considerably less efficient.

The temperature difference between one flow and the opposite flow in the supplemental HEX is, as noted above, set by the pressure dropping valve 132. This temperature difference is typically set at about the same difference between the boiling temperature of the two phase fluid in load 130 and the temperature of the pure gas as it goes to the input of compressor 112. This temperature difference is called the evaporator "superheat" and in practice varies from about 3° C. to about 15° C.

The TXV 119 plays a significant role in the measurement of superheat because the pressure difference across the TXV 119 diaphragm controls the degree of opening of the TXV 119. At a maximum superheat of 15° C., with R134a refrigerant, for example, the pressure difference would be about 3.3 bar (about 50 psi) and would represent a wide open valve. If the pressure difference approaches zero bar, and the superheat approaches zero, the TXV 119 would be shut, or nearly so. To achieve balance in these respects, the fluid filling the sensing bulb 122 coupled to the TXV 119 is chosen to have a vapor pressure similar to, but not necessarily identical to, that of the refrigerant used in the cooling cycle. As noted above, the pressure drop in the post condensation step from point ($T_6$) to point ($T_8$) is selected to introduce a temperature change approximately the same as the superheat used to regulate the cooling temperature.

Figure 3:
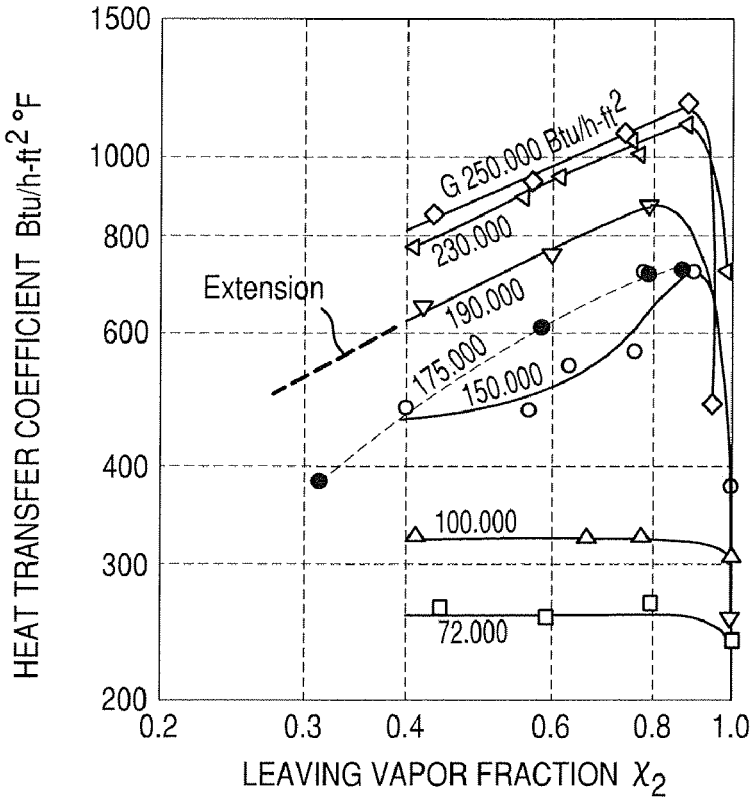
FIG. 3 is a graph showing variations in h with respect to the percentage of leaving vapor fraction in the flow of a two-phase fluid within an evaporator.
Figure 4:
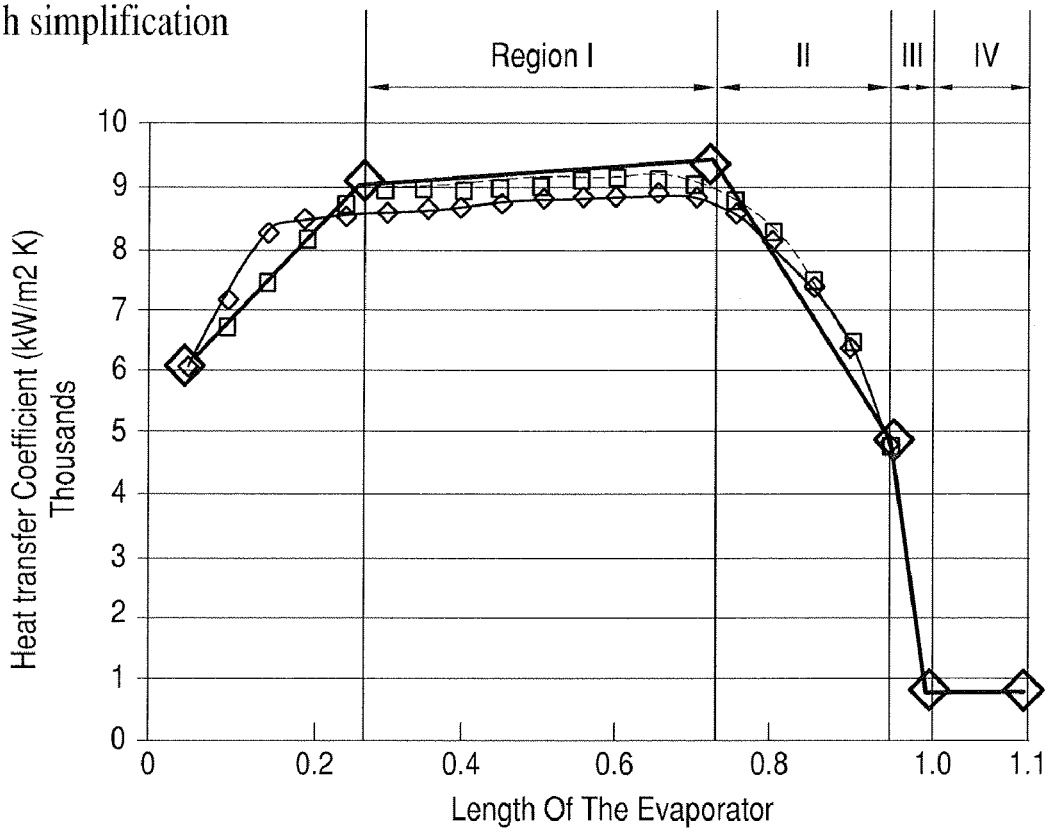
FIG. 4 is a graphical depiction of h variations in relation to lengthwise positions in an evaporator as shown in FIG. 2.

FIGS. 3 and 4 also show how h varies with the changing dynamics of the refrigerant, its velocity and quality. In FIG. 3 h is plotted against heat transfer values for different "leaving vapor fractions", while in FIG. 4 the variation of h is plotted against the length of the evaporator in relation to the four regions identified in FIG. 2. FIGS. 2-4 show clearly that the h drops by more than 50%, as the dry end of the evaporator is approached. This unbroken decline is a result of the status of the refrigerant mass as its vapor/liquid ratio changes, and is not economically resolvable by practical design expedients in the evaporator. A so-called flooded evaporator is used in those applications wherein the weight and size of the evaporator is a significant design parameter. In this case the superheat in the evaporator is held to zero. A small amount of liquid, typically about 5%-10%, remains in the refrigerant leaving the evaporator. This is less efficient than if the refrigerant leaves the evaporator as a pure gas somewhat elevated in temperature (superheated), but the smaller evaporator that the increase in h allows (ref. FIG. 4), somewhat makes up for the lowered efficiency in applications such as automotive air conditioners and the like. The lack of efficiency is less desirable at the present time than in the past due to the looming energy shortage.

Figure 10:
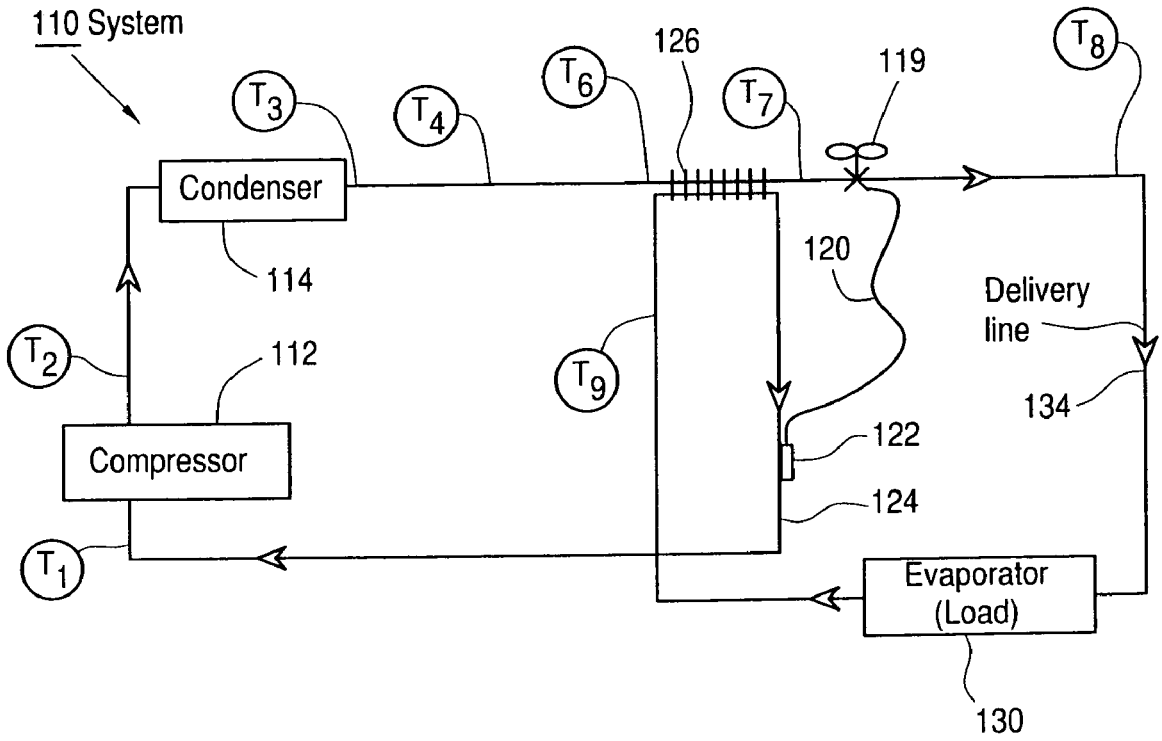
FIG. 10 is a block diagram representation of an alternate system using enhanced post condensation.

FIG. 10 shows a block diagram of an EPC system that is different than that of FIG. 1 in that subsidiary HEX 126 is located in the flow of refrigerant before TXV 119 rather than after. This system offers the advantage that the temperature difference across EPC HEX 126 is greater and the use of pressure differential valve 132 is not needed. HEX 126 must be run in parallel flow in this system for proper stability to be achieved. It is also possible to run the system of FIG. 10 with a TXV that is internally equalized since there can potentially be only a small pressure drop in the circuit from TXV 119 to the location of bulb 122 in line 124.

Figure 11:
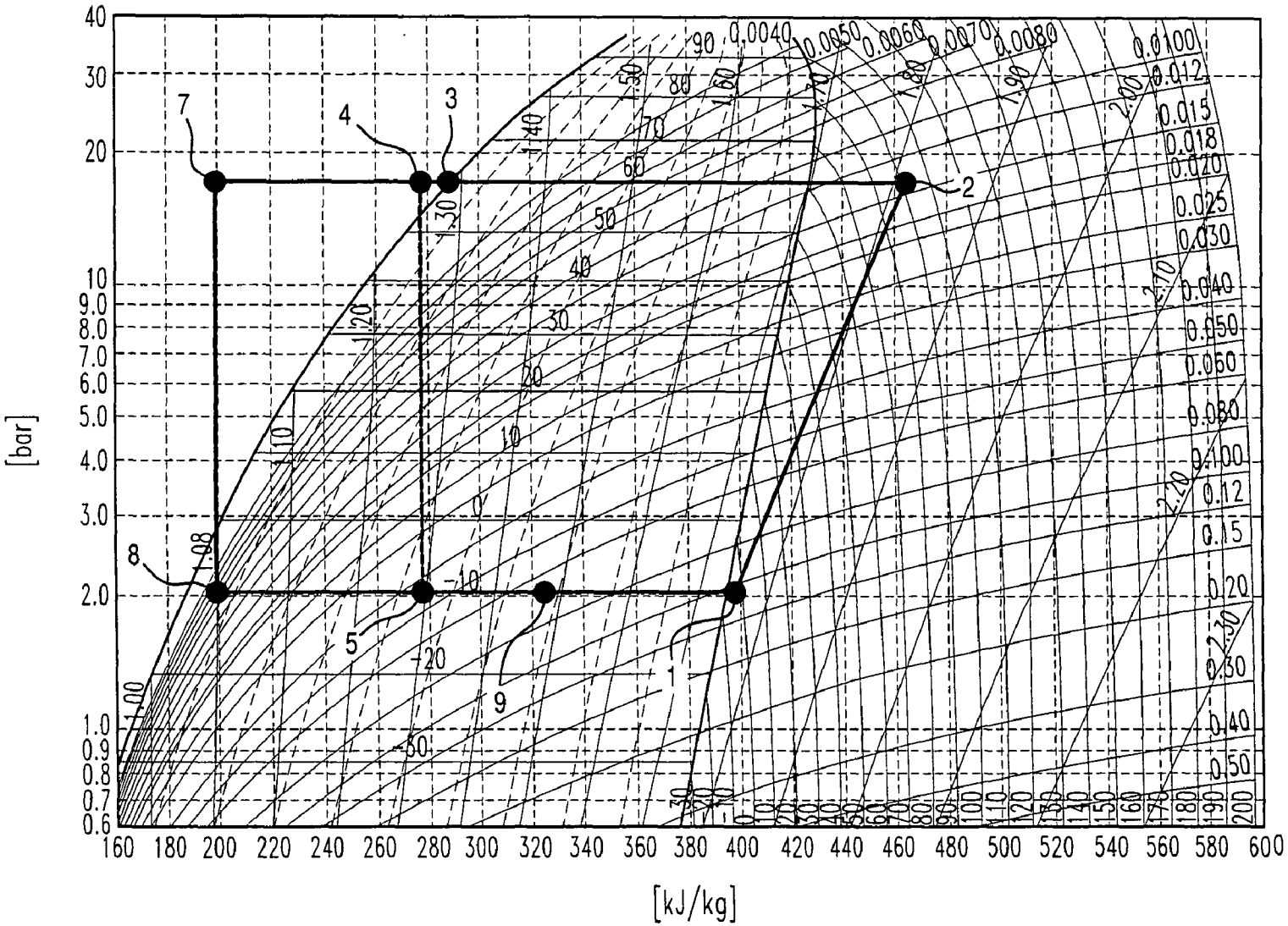
FIG. 11 is a Mollier diagram of the operation of the system depicted in FIG. 10.

FIG. 11 shows a Mollier diagram of the system shown in FIG. 10. This graph shows the effectiveness of the EPC concept in the FIG. 10 system, comparable to the diagram of FIG. 5 for the system of FIG. 1. If the system were to function as a standard vapor-cycle system the expansion from $T_4$ to $T_5$ would leave the heat transfer in load 130 boiling a mix from 45% quality to a superheat of 5° C. This would cause the same problems of heat transfer as discussed in the case of the system of FIG. 1. With the EPC in place the boiling from $T_8$ to $T_9$ changes the mix from a quality of 5% to 65%. This clearly increases the heat transfer effectiveness of the HEX in load 130 in the same manner as with the system of FIG. 1.

Figure 6:
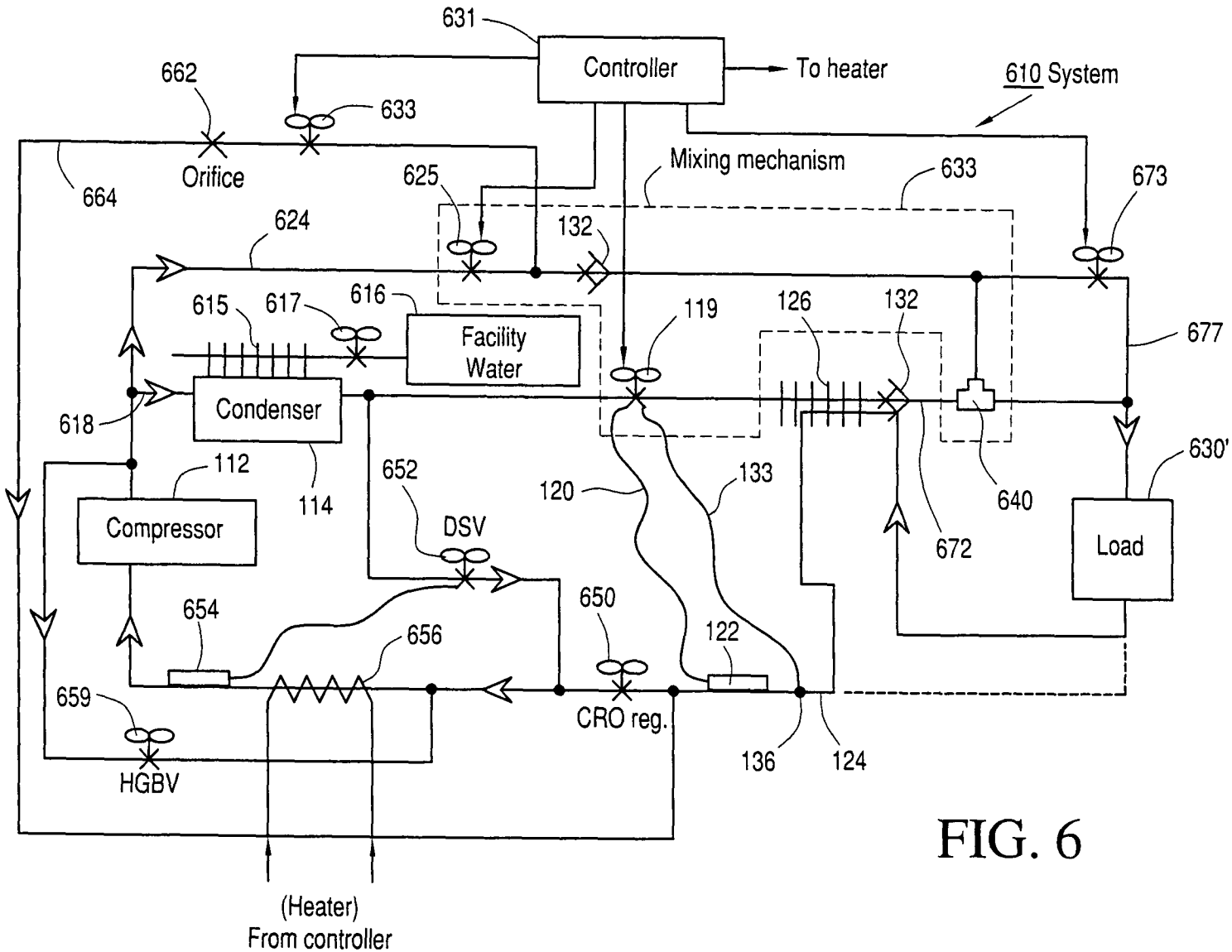
FIG. 6 is a block diagram representation of a system using enhanced post condensation in conjunction with the direct transfer of saturated fluid (TDSF) concept.

A temperature control system of the TDSF type, as shown in FIG. 6, corresponds to that disclosed in U.S. Pat. No. 7,178,353 but includes an enhanced post condensation (EPC) variant, without altering the basic operative characteristics of the TDSF system. In the system 610, those units and components which function similarly to counterparts in the system 110 of FIG. 1, are designated by like numbers. A two-phase refrigerant medium is pressurized in a conventional compressor 112, and its output is divided into two paths, one of which is directed to a condenser 114. The condenser 114 is shown with an external HEX 615 which receives flow from a conventional source, here from a facility water source 616. The flow is regulated by a valve 617 that may be controlled manually or automatically to maintain the output from the condenser 114 at a selected level. One flow path from the compressor 112 is a first liquid/vapor path 618, through the condenser 114 and feeding a thermo-expansion valve (TXV) 119. The second flow path from the compressor 112 proceeds from a branch point and comprises a hot gas line 624 which feeds a proportional valve 625. The proportional valve 625 operates under control of a system controller 631, and the two lines 618, 624 feed into a mixing mechanism or circuit 633. As also disclosed in the above-referenced Cowans et al '353 patent, the flow in the hot gas line 624 goes from the proportional valve 625 through a check valve 632 to one input of a mixing tee 640. The other input to the mixing tee 640 is applied via a Δp valve 132 which receives flow passing through the TXV 119, and drops the pressure and temperature in that line by a predetermined amount.

With this integrated dual flow thermal control system 610 in operation, an adjustable mix of hot and fluid/vapor flows at predetermined pressure and temperature from the mixing tee 640 and is directed toward and ultimately through the load 630'. It is then cycled back from the load 630' to the input to the compressor 112, via flow paths including various known elements and devices which assure stable, continuous operation as described hereafter. For example, the thermo-expansion valve 119 is externally equalized by pressure input from the return line 124 in the region near bulb 122 in thermal communication with the return line 124 to the compressor 112 via a line 120. The TXV 119 is equalized via a pressure tap through a line 133 from outlet line 124. It is necessary that the TXV 119 be externally equalized thusly in all EPC systems of the type shown in FIG. 1 using a TXV. There must be a large pressure difference between the TXV 119 and the location of the bulb 122. This is due to the pressure difference established by differential pressure valve 132. TXVs that are internally equalized measure the difference between the bulb pressure and the pressure at the outlet of the TXV. If a larger than nominal pressure difference exists between the TXV and the circuit near bulb 122, the TXV must be externally equalized. This is clearly the case with the EPC system shown in FIG. 1. The return flow also passes through a close-on-rise (CRO) regulator 650, which regulator limits the pressure fed to compressor 112 within design limits. The flow rate is kept within acceptable temperature limits by a branch line that contains a desuperheater valve (DSV) 652 between the output from the condenser 114 and the input to the compressor 112.

In accordance with conventional practice the desuperheater valve 652 receives a pressure input from a bulb 654 adjacent the compressor 112 input. A heater 656 responsive to the controller 631 is included to assure that the compressor 112 does not receive an input containing liquid components. Further operative stability is derived by incorporating a hot gas bypass valve 659 in a feedback line between the compressor 112 output and its input.

The input line to the load 630' from the mixing mechanism 633, which includes a tee 640, goes through one side of an EPC HEX 126 and then through a Δp valve 132 before being applied to the load 630'. Return flow from the load 630' toward the compressor 112 passes through the opposite side of the HEX 126 before ultimately reaching the compressor 112 via the interposed valves and devices.

Also, rapid shutdown of hot gas flow can be realized because of the incorporation of a shunt line 664 as a bypass from a point between the hot gas line 624 after the proportional valve 625. The bypass line 664 includes a solenoid valve (SXV) 663 and an orifice 662. In the event it is determined that a rapid drop in temperature is needed or desirable the controller 631 opens the SXV 663 to effectively severely diminish the hot gas flow to mixing tee 640 so that the cooled expanded flow from the line 672 solely determines the operating temperature.

Referring now to the Mollier diagram of FIG. 7, in the TDSF system with enhanced post condensation (EPC) when under load the heat transfer cycle traces steps on the pressure enthalpy diagram between transition points that can be described as follows:

Point 1=input to compressor 112

Point 2=output from compressor 112

Point 3=liquefying point of refrigerant within condenser 114

Point 4=subcooled output of condenser 114 and the input to TXV 119

Point 5=output from TXV 119 if not enhanced with EPC system

Point 6=output from TXV 119 and input to HEX 126

Point 7=output from HEX 126

Point 8=output after ΔP valve 1

Point 9=output after absorbing heat from load 630' (return to point 1 after HEX 126)

Figure 7:
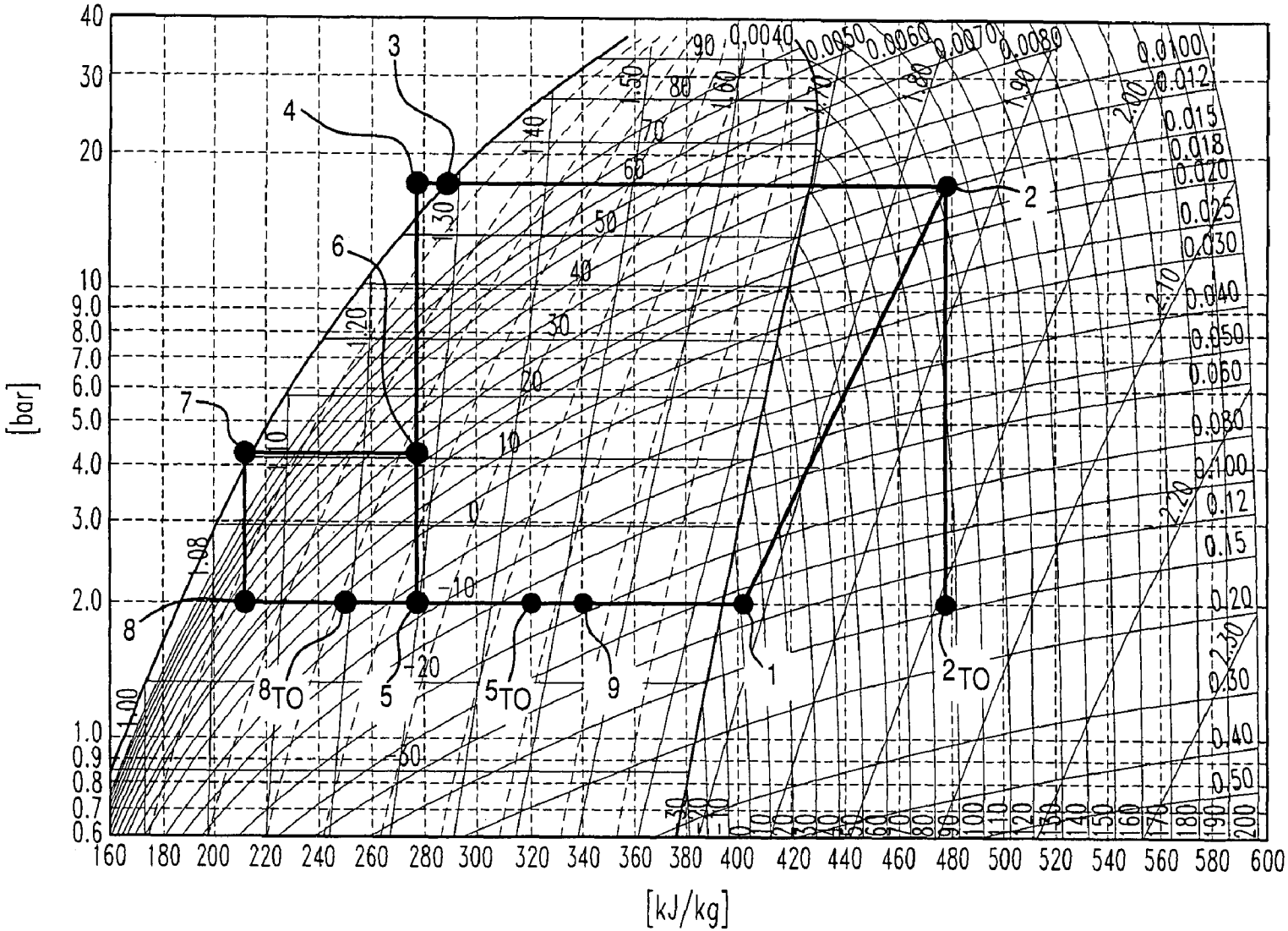
FIG. 7 is a Mollier diagram of enthalpy vs. pressure showing the general sequence of changes during cycling of two-phase refrigerant in the system of FIG. 6.

In the cycle shown in FIG. 7, the states change from points 1 to 2 to 3 and 4, then down to point 6, through HEX 126, and turning again at point 7. At point 7 the refrigerant passes through pressure dropping valve 132 to point 8. Thereafter the flow returns back to point 1, to again recycle, and as it does so, it exchanges thermal energy with the flow in the load-directed flow path in the smaller HEX 126 of FIG. 6. This overall outline corresponds broadly to the Mollier diagram of FIG. 5, discussed above relative to the EPC diagram of FIG. 1. The increase in h that the use of the EPC provides can be clearly evaluated with reference to FIG. 4 by comparing it to the average h in a real conventional HEX, as discussed hereafter.

The TDSF alters the temperature by introducing a heat load from the hot gas at point 2. This controls the temperature at load 630' as explained below. As stated, the TDSF adds a heat load to adjust the temperature. In the cycle shown in FIG. 7 the heat load that can be cooled by a standard cycle is represented by the enthalpy change from point 5 to point 1. For a typical load, represented by the enthalpy change from point $5_{T0}$ to point 1, the cooling potential from point 5 to point 1 is excessive. If there were to be no added heat load the cycle would cool load 630' below the temperature shown and temperature control would thus be lacking. The TDSF system adds a heat load by combining an appropriate amount of hot gas from point 2 expanded to point $2_{T0}$ with the mix at point 8 so that the result is a mix at point $5_{T0}$. Thus the system and heat load 630' would be in balance at the correct regulated temperature.

As the mix absorbed heat in cooling load 630' the problems of heat transfer in a high quality mix of vapor and liquid as discussed above would be present. As the mix boiled off liquid from 70% to 100% quality the h would decrease as shown in FIG. 4. This would result in the load 630' increasing its temperature in those areas locally cooled by the high quality mix and by the superheating gas.

The EPC system overcomes this problem. The EPC system mixes hot gas expanded to point $2_{T0}$ with the output of the valve 132. In this case the resultant mix is combined at point $8_{T0}$. The mix then boils off in cooling the load 630' to point 9. Thus, as the mix leaves load 630' it has a quality of about 74%, and the h is at or near maximum. The mix then enters the exit side of the HEX 126 in post condensing the mix on the input side of the HEX as well as cooling any losses incidental to the process. The outgoing fluid heats from point 9 to point 1 in the process of cooling the incoming fluid from point 6 to point 7. The fact that the h is low in the final stages of this process is of no consequence to the load 630' temperature.

The TDSF alters the temperature by introducing a heat load from the hot gas at point 2. This controls the temperature at load 630' as explained below. As stated, the TDSF adds a heat load to adjust the temperature. In the cycle shown in FIG. 7 the heat load that can be cooled by a standard cycle is represented by the enthalpy change from point 5 to point 1. For a typical load, represented by the enthalpy change from point $5_{T0}$ to point 1, the cooling potential from point 5 to point 1 is excessive. If there were to be no added heat load the cycle would cool load 630' below the temperature shown and temperature control would thus be lacking. The TDSF system adds a heat load by combining an appropriate amount of hot gas from point 2 expanded to point $2_{T0}$ with the mix at point 8 so that the result is a mix at point $5_{T0}$. Thus the system and heat load 630' would be in balance at the correct regulated temperature.

The enhanced post condensing elements in the system of FIG. 6 comprise the HEX 126 (or EPC HEX) and the pressure dropping valve (or EPC valve) 132. One side of this HEX 126 is in the direct path from the mixing tee 640 to the load 630' input, and the path on the other side of the exchanger 126 receives the output flow from the load 630', and returns it ultimately to the compressor 112. While providing functions equivalent to those described previously in the EPC example of FIG. 1 in the TDSF system this also provides operative capabilities unique to the dual flow dynamic of the TDSF system and the asymmetries that can arise therefrom.

The effect of the EPC on the TDSF system is particularly beneficial in the case of temperature regulation of a load under very low or essentially zero load. If a load is being controlled with a system capable of cooling or heating several kilowatts (kw) it is very difficult to effect precise control when there is little or no load externally imposed. This is a common case in the Semiconductor industry. A system can be called on to absorb or supply 1-3 kw of heat with a precision that ensures a load temperature within ±1° C. It can also be required to maintain the same load at temperature under conditions during which almost no load is being supplied. This is difficult with any temperature control system. The TDSF system has an especially difficult time with the zero or no load case because of the details of heat transfer within the TDSF system. Basically, the problem is that liquid condensing hs are orders of magnitude higher than those encountered with gas transferring sensible heat.

Figure 8:
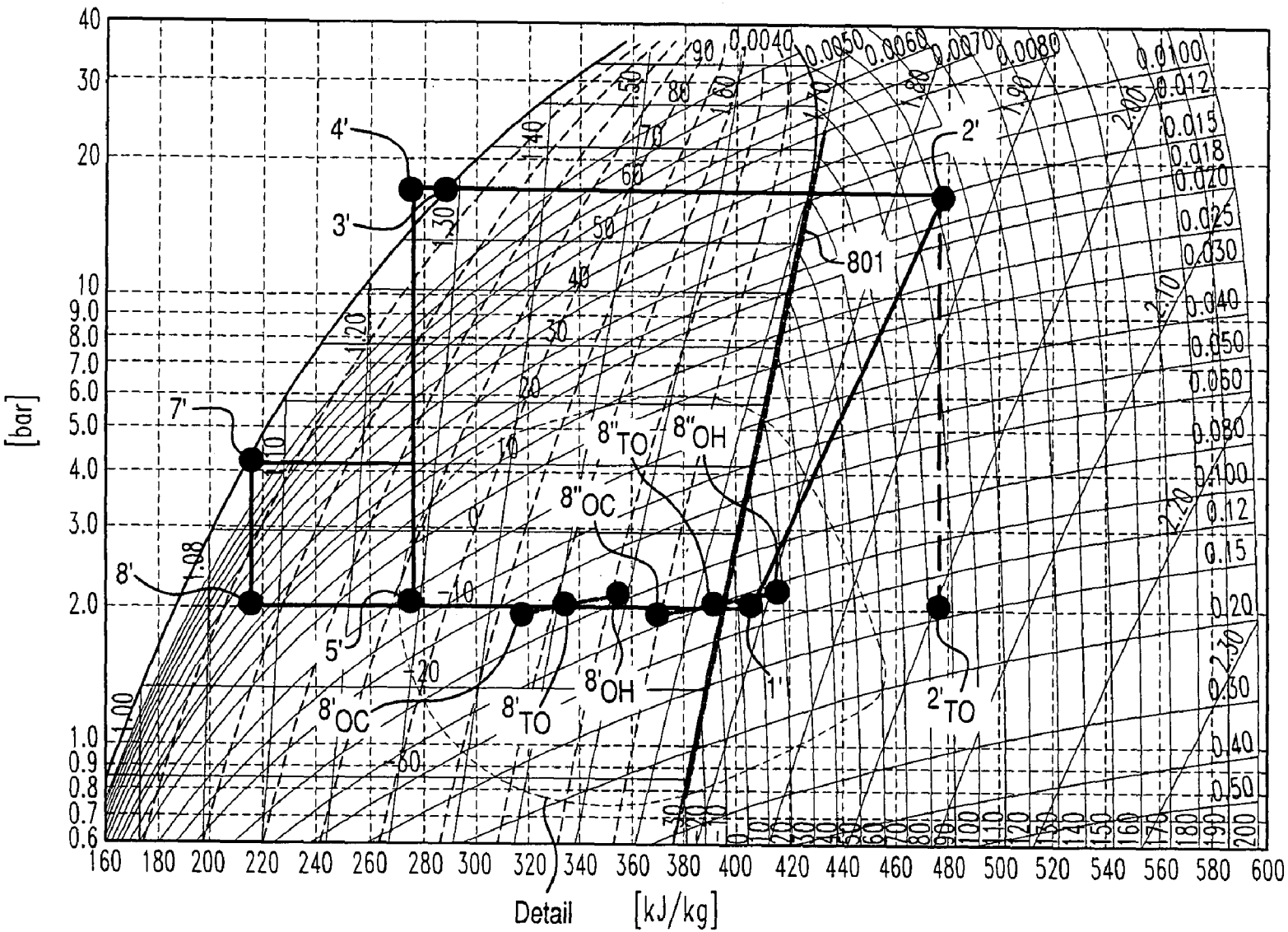
FIG. 8 and "FIG. 8 Detail" are a Mollier diagrams showing various operating states and alternative changes in thermodynamic factors in the cycling of the system of FIG. 6. useful in explaining conditions involved and making small corrections.

FIG. 8 illustrates the problem. If the load power to be controlled is at or near zero the mixing of hot gas expanded to point $2'_{T0}$ with the mix at 8' would result in a mixture at $8''_{T0}$ without EPC. As controller 631 makes small adjustments for the purpose of keeping the load at the set temperature under dynamic conditions the control mixture will vary between points such as $8''_{0H}$ to $8''_{0C}$. (The movement of the control points has been exaggerated for clarity. The actual movement would generally be about a ⅓ of that shown in FIG. 8.) A small error on the hot side would move the mixture point very far from the control point desired. This is because a large amount of heat power (e.g. 5 kw) is combined with a like amount of cooling power to arrive at a near zero sum. An error of only 3% results in an overshoot of 150 watts. This factor is exacerbated by the fact that any error in the heating direction is accompanied by a bias in h of orders of magnitude more than the coefficient of gas transfer. It will be noticed that there is a slope in the line connecting $8''_{0H}$ to $8''_{0C}$. This is due to the fact that opening the proportional valve 625 allows more refrigerant to flow which, in turn, raises the pressure of fluid within load 630'. Consequently the temperature of the fluid mix also rises. The opposite also occurs on valve 625 closing. The minutiae associated with the changes in temperature and state can be better seen in the supplementary diagram designated FIG. 8 Detail.

The EPC system alleviates this problem considerably. With the use of EPC the combination of hot gas expanded mixed with the two phase fluid blends at point $8'_{T0}$ instead of $8''_{T0}$. In this situation an error, particularly on the heating side, has much less significance. In this case, with EPC, any error simply results in a slight change in quality. One can see clearly in FIG. 4 that a small change, say from 80% to 85% quality only changes h by about 10% instead of orders of magnitude. This alleviates the control problem substantially.

Figure 9:
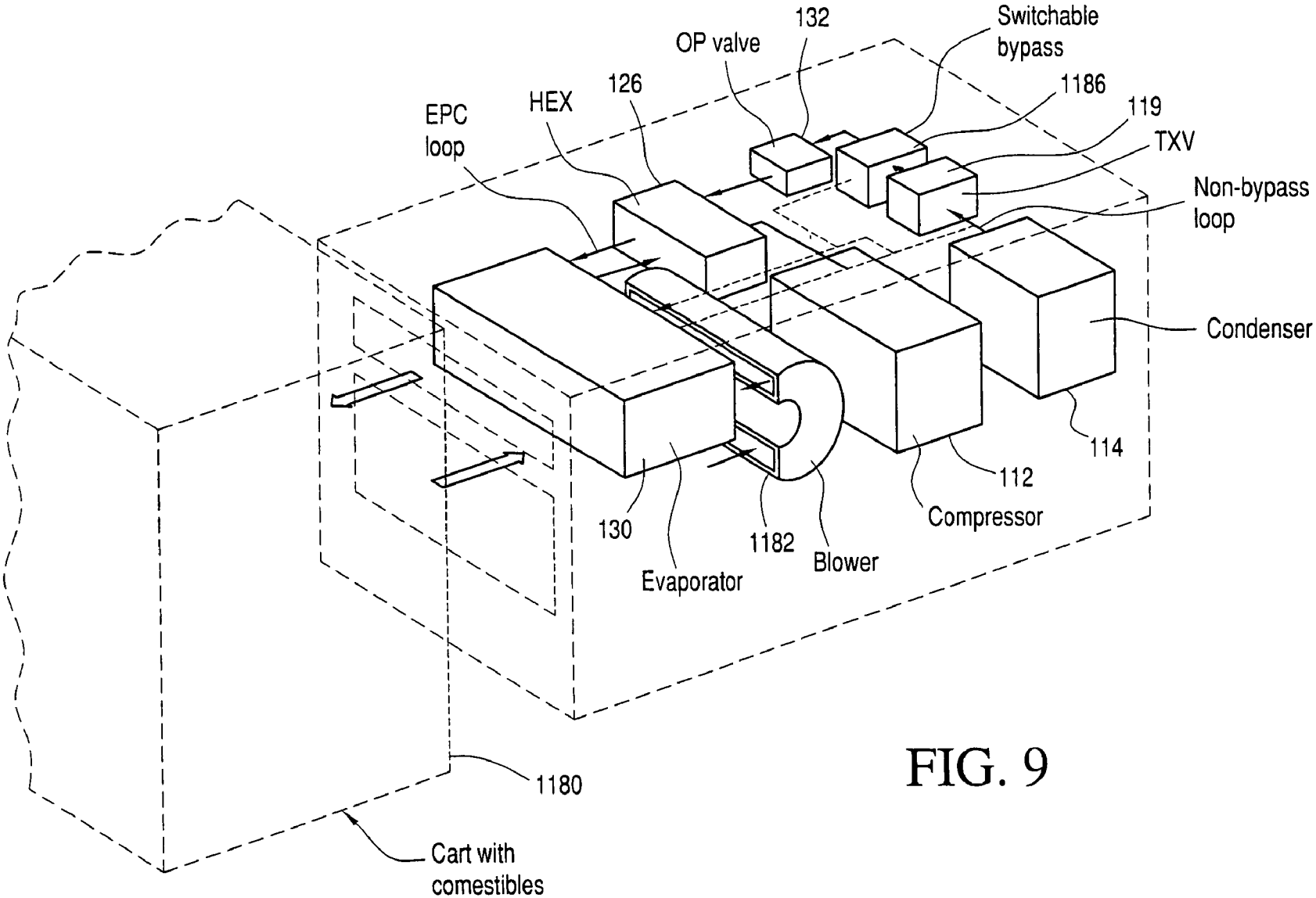
FIG. 9 is a perspective view, partially broken away of a modified thermal control system for a commercial air cooling system incorporating enhanced post condensation in accordance with the present invention and including a switchable variant to a conventional operation to provide comparative results.

A practical example of efficiency improvement achieved in an existing air cooling system is provided by a 7000 BTU/hr air cooler used in commercial passenger aircraft to chill food transported along the passenger compartment in mobile service carts. The system operates with R134a refrigerant kept between 50° C. condensing and 5° C. evaporating temperature. The illustrative system, referring now to FIG. 9, is set up with a switchable bypass for objective tests as shown in the generalized schematic perspective to compare an existing refrigeration system with one using enhanced post condensation in accordance with the invention. In this test system of FIG. 9, the cycling gaseous refrigerant was pressurized by the compressor 112 from about 12° C. and 6 bar pressure to a pressure of about 20 bar at 90° C., and the refrigerant was then cooled by the condenser 114 to a liquid, at approximately ambient temperature and high pressure. In passing through the TXV 119, in the basic configuration (dotted line) the refrigerant was expanded to a mixture of liquid and gas at a lower temperature and pressure, here approximately 5° C. and 6 bar, and then delivered to the load evaporator 630'.

The load 630' comprises in this practical example a portable cart 1180 containing cooled or refrigerated comestibles such as drinks, desserts, sandwiches (not shown) all within the cart and exterior to the base unit. Air movement through the base unit and cart 1180 is facilitated by a blower 1182 behind the evaporator 130, since the flow impedance within the cart 1180 can be considerable and thermal energy Interchanged in the evaporator with cooled refrigerant is to be transferred from the counter-current refrigerant flow to an ultimately external air flow to the cart 1180. The refrigerant, as pure gas, transferred back from the evaporator 130 to the suction input of the compressor 112 is at a temperature slightly warmer than the boiling temperature within the evaporator 130. Compression is again applied as the cycle is repeated. The known, widely used, exemplification of this system generates 7000 BTU, but since the system is airborne and intended for passenger service, improvement in efficiency can have significant benefits in enabling size and weight reductions or substantial cost savings.

In the practical system for demonstrating the efficacy of the enhanced post condensation expedient, as alternatively shown in FIG. 9, the refrigeration loop was modified by incorporating the relatively small HEX 126. In the test setup as shown, however, the separate internal loop was accessible by a switchable bypass 1186 after the TXV 119, so that refrigerant flowed to the smaller counter-current HEX 126 (solid line) instead of directly to the load. Then the flow was through the ΔP valve 132 and into the load 630'. On the return path to the suction input to the compressor 112, the refrigerant counter flowed through the HEX 126 with relatively low pressure drop, and then returned to the suction input to the compressor 112.

Comparison of the chilling effects achieved by the enhanced post condensation version of the same system with the prior art commercial system revealed an efficiency improvement of 10% to 30%. Since the auxiliary HEX can be relatively smaller for the same net thermal units, the cost penalty is essentially minor. This technique for improving vapor cycle efficiency by overcoming limitation on the local quality of the refrigerant mass is applicable to other heat transfer problems as well.

Although various improvements and modifications have been shown or described above, the invention is not limited thereto but includes all concepts and expedients within the scope of the appended claims.

We claim:

1. A temperature control system employing a two-phase refrigerant and a compressor/condenser loop having an input and output for circulating refrigerant at a controllable temperature to and from a load evaporator having input and output terminals and a known thermal capacity, the temperature control system including a subsidiary heat exchange loop for enhancing the performance of the system by advantageously utilizing the different thermal energy transfer properties of the two phases of the refrigerant, comprising:

a subsidiary heat exchanger coupled between the flow from the output of the compressor/condenser loop to the load evaporator input, the subsidiary heat exchanger having a smaller thermal capacity than the known thermal capacity of the load evaporator, said subsidiary heat exchanger having a first flow path including an input receiving flow from the compressor/condenser loop and an output therefrom coupled to the load evaporator input, and the subsidiary heat exchanger also including a second flow path in counterflow thermal exchange relation along the length of the first flow path, the second flow path including an input receiving flow from the load evaporator output and providing an output flow coupled back to the input to the compressor/condenser loop, at least one temperature-modifying device in series circuit with the input to the first flow path and prior to the subsidiary heat exchanger for lowering the temperature of the flow output therefrom that is input to the load evaporator and increasing the bulk density of the flow therefrom to the evaporator, whereby although the proportion of liquid in the refrigerant mix fed to the load evaporator is partially reduced, the bulk density of the mass moving through the load evaporator is thereby increased to minimize heat transfer losses in the low efficiency region of the load evaporator, and wherein the subsidiary heat exchanger is configured to transfer thermal energy between the two flow paths therein such that the refrigerant flowing in the second path is returned to the compressor/condenser loop in gaseous state.

2. A system as set forth in claim 1 above, wherein the at least one temperature-modifying device comprises a thermo-expansion device in the first flow path prior to the subsidiary heat exchanger, the thermo-expansion device including and being responsive to a pressure sensing device responsive to the pressure in the input line to the compressor and wherein the system further comprises a pressure dropping device in the first flow path subsequent to the subsidiary heat exchanger and prior to the evaporator, said pressure-dropping device introducing a pressure differential driving the counterflows of fluid in the first and second flow paths through the subsidiary heat exchanger.

3. A system as set forth in claim 2 above, wherein the system further comprises a subsystem in the compressor/condenser loop for providing a combined flow at controllable temperature to the evaporator, said subsystem including a first direct flow control for providing a selected proportion of hot gas flow from the compressor and a second derivative flow control for providing a selectively expanded and cooled flow from the condenser, subject to the proportion provided by the first direct flow control and a mixing circuit receiving the first and second flows for providing a combined flow therefrom to the evaporator via the subsidiary heat exchanger.

4. In a thermal control system using the different thermal transfer characteristics of the phases of a two-phase refrigerant and including a refrigeration loop of operative elements incorporating a compressor, a condenser, and an expansion device in sequence, the refrigeration loop being in thermal communication with an evaporator comprising the load to be cooled, the evaporator having a nonlinear heat transfer coefficient in response to localized refrigerant quality variations, wherein quality is expressed in terms of the proportion of vapor mass to total mass, the improvement comprising a subsidiary heat exchange loop disposed between the expansion device and the evaporator and including a counter-current heat exchanger coupling the expansion device to the evaporator on one side and the output from the evaporator to the compressor on the other side, the loop further including a differential pressure device in the coupling between the counter-current heat exchanger output and the evaporator input selected to lower the temperature of flow to the evaporator to a degree approximating the difference between the evaporating refrigerant and the load being cooled, the loop also including a pressure sensing device responsive to the pressure in the output line from the counter-current heat exchanger to the compressor input, and controlling the operation of the differential pressure device in the refrigeration loop.

5. A combination as set forth in claim 4 above, wherein the refrigeration loop comprises a thermo-expansion device including a vapor confining sensing bulb responsive to the temperature of the refrigerant being returned to the compressor from the heat exchanger, the sensing bulb having an internal fluid selected to have a chosen vapor pressure to approximate that of the refrigerant used in the cooling cycle.

6. A system as set forth in claim 4 above, wherein the differential pressure device in the coupling between the counter-current heat exchanger output and the evaporator input is selected to provide a temperature change approximating the superheat of the evaporator.

7. A thermal control system as set forth in claim 4 above, wherein the refrigeration system includes a system for mixing refrigerant media in expanded at least partially vapor phase after condensation and the same refrigerant in pressurized gas phase, including a mechanism for mixing the two different phases for application to the evaporator of given thermal capacity, wherein the subsidiary heat exchange loop is disposed between the mixing mechanism and the evaporator.

8. A system as set forth in claim 7 above, wherein the pressurized gas phase has substantially greater energy content that the expanded vapor phase and wherein the subsidiary heat exchange loop stabilizes the entire thermal control system for effecting relatively small incremental temperature changes.

9. In a compression/condensation temperature control system using a two-phase refrigerant for controlling the temperature of a load evaporator of a known thermal capacity by combining high pressure hot gas flow from a source modulated at a selectable flow rate with a derivative remainder flow from the source that is cooled to a vapor/fluid condensate of the refrigerant, the improvement comprising:

a command source varying the hot gas flow, and thereby the derivative flow, prior to the combination thereof;

a counter-current flow heat exchanger having a first flow path coupling the combined flow to the load evaporator and having a second, counter-current, flow path coupling the flow from the load back to the compression/condensation system, said heat exchanger having a lesser thermal capacity relative to that of the load evaporator, and a device in the first flow path between the heat exchanger and the load evaporator for lowering the pressure of the combined flow delivered to the evaporator by a selected amount, to assure circulation through the load evaporator and back to the compression/condensation system while maintaining the quality of the two-phase refrigerant in a selected range above zero.

10. A thermal control system using a refrigerant flowing in direct contact with a thermal load having a known thermal capacity whose temperature is to be controlled, comprising:

a source of a thermal medium having a two-phase characteristic and a liquid/gas transition within a chosen operative temperature and pressure range applicable to the system;

a compressor receiving the thermal medium and providing a compressed gas output at a first elevated temperature and first elevated pressure;

a first flow control receiving the compressed gas output and providing a first variable mass flow at an elevated temperature;

a medium condenser receiving that portion of the compressed gas output remaining when the first variable mass flow is provided from the first flow control and a liquid pressurized output is provided from the portion remaining at a second lower temperature level;

a second flow control comprising an externally stabilized expansion device receiving the liquid pressurized output from the medium condenser and providing the second flow as a selectively cooled expanded output at a reduced pressure;

a controller coupled to operate the first flow control for establishing a selected proportional relationship between the first and second flows of the thermal medium;

a mixing circuit receiving the first and second flows and providing a combined output to the load;

a subsidiary heat exchanger having counter-flowing paths, a first of said paths receiving the combined output from the mixing circuit and being between the second flow control and the load, and the second of said paths receiving the return flow from the load and being between the load and the medium compressor, said subsidiary heat exchanger having a lower thermal capacity relative to the known thermal capacity of the load, and a pressure dropping valve between said subsidiary heat exchanger and the load to reduce the pressure and temperature of the flow that is applied to the thermal load being controlled.

11. In a temperature control system employing a two-phase refrigerant and a compressor/condenser series in a loop also including an expansion valve for cooling the refrigerant to provide a cooled expanded two-phase flow to a load evaporator in the loop, the improvement comprising:

a subsidiary counter-flow heat exchanger in the loop between the compressor/condenser series and the load evaporator, said subsidiary heat exchanger passing input flow in the two-phase state from the compressor/condenser series to the load evaporator on a first side, and passing return flow in two-phase state from the load evaporator on the second side, the thermal capacity of said subsidiary heat exchanger being less than the thermal capacity of the load evaporator;

a temperature dropping device in the input path on the first side of the subsidiary heat exchanger for insuring a temperature differential between the two sides sufficient to insure flow of refrigerant and transfer of thermal energy through the evaporator and to reduce heat transfer losses in the load evaporator by reducing the rate at which the two-phase refrigerant converts to vapor; and wherein the expansion valve is coupled into the first side path prior to the subsidiary heat exchanger and the temperature dropping device comprises a pressure dropping valve coupled in the first side path between the subsidiary heat exchanger and the load evaporator and introducing a temperature drop approximating the difference between the evaporating refrigerant and the load being cooled.

12. A temperature control system improvement as set forth in claim 11 above, wherein the expansion valve is a thermo-expansion valve including a sensor responsive to the temperature in the second path output from the subsidiary heat exchanger.

* * * * *